US005995798A

United States Patent [19]

Ochi et al.

[11] Patent Number: 5,995,798

[45] Date of Patent: Nov. 30, 1999

[54] FIXING DEVICE EQUIPPED IN IMAGE FORMING DEVICE

[75] Inventors: Norihiro Ochi, Sakurai; Hisashi Yoshimura, Nara; Hajime Horinaka, Kashiba, all of Japan

[73] Assignee: Sharp Kabushiki Kaisha, Osaka, Japan

[21] Appl. No.: 09/120,403

[22] Filed: Jul. 22, 1998

[30] Foreign Application Priority Data

Sep. 29, 1997 [JP] Japan ..... 9-263320

[51] Int. Cl.[6] ..... G03G 15/20

[52] U.S. Cl. ..... 399/325; 118/260

[58] Field of Search ..... 399/324, 325, 399/326; 118/DIG. 1, 260, 264; 219/216

[56] References Cited

U.S. PATENT DOCUMENTS

| | | | |
|---|---|---|---|
| 3,943,540 | 3/1976 | Vanderheyden | 118/260 X |
| 4,426,953 | 1/1984 | Kromm, Jr. et al. | 399/326 X |
| 4,899,197 | 2/1990 | Davis et al. | 399/326 |
| 4,905,049 | 2/1990 | Bickerstaff et al. | 399/325 |
| 5,099,289 | 3/1992 | Kurotori et al. | 399/325 X |
| 5,278,617 | 1/1994 | Boisvert et al. | 399/325 |
| 5,356,473 | 10/1994 | Fromm | 219/216 X |
| 5,504,566 | 4/1996 | Chow et al. | 219/216 X |
| 5,800,908 | 9/1998 | Hobson et al. | 118/260 X |

FOREIGN PATENT DOCUMENTS 6-202 518 7/1994 Japan .

*Primary Examiner*—William Royer
*Assistant Examiner*—Sophia S. Chen
*Attorney, Agent, or Firm*—David G. Conlin; William J. Daley, Jr.

[57] ABSTRACT

Featured is a fixing device provided in an image forming device that includes a heat roll, a pressurization roll, an application member and a blade member. The heat roll has a surface that is heated to a desired temperature by a heating source and the pressurization roll presses a recorded medium (e.g., a paper sheet) holding an unfixed image to the heat roll. In this way, the unfixed image is fixed to the recorded medium by passing it between the heat roll and pressurization roll. The application member applies a release agent to the heat roll for preventing adherence of the unfixed image held on the recorded medium to the heat roll, where the release agent is impregnated to the application member and applied to the heat roll by capillary action. The blade member controls the application of the release agent so it is uniformly applied to the heat roll and removes excessive release agent to be applied on the heat roll. The application and blade members are positioned so that opposing end surfaces are adjacent to each other. In a more particular embodiment, the blade member is positioned adjacent a tip of the capillary of the application member. This advantageously results in suppressing a remaining release agent upstream of the blade member by the application member and automatically controlling the amount of the release agent carried up by the application member. In this way, the application region in the tip portion of the application member is in a saturated state and the excessive supply of the release agent is limited, which leads to stabilization of the supply quantity and the prevention of excessive release agent. Additionally, such an arrangement also prevents the dripping of the excessive release agent when applying the release agent.

5 Claims, 6 Drawing Sheets

FIXING DEVICE EQUIPPED IN IMAGE FORMING DEVICE

BACKGROUND OF THE INVENTION

The present invention relates to a fixing device for heat-fixing an unfixed toner image (yet to be fixed toner image) on a sheet (paper) which is a recorded medium equipped in an image forming device such as a copying machine, laser beam printer, facsimile and the like using an electrophotograph method.

The image forming device utilizing an electrophotograph method creates a manifest image by powder toner from a latent image formed on a photosensitive body having a photosensitive layer which works as a recording medium, and transfers said manifested toner image onto a sheet-type paper which is the recorded medium, and since said toner is yet to be fixed, heat is applied to melt the toner, and then pressure is added thereto to fix said toner image onto the paper. In order to do so, a fixing device is provided on the downstream side of a paper conveyance passage which passes through an image forming region, for example, just before a discharge portion of the paper.

One example of conventional fixing device disclosed for example in Japanese Laid-Open Patent Publication No.6-202518, is formed of a heat roll having in the interior thereof a heater lamp comprising a halogen lamp as the heating source and a pressurization roll pressurized to said heat roll by a predetermined pressurization force, and is positioned on the upstream side of a discharge portion of the conveyance passage which passes through an image forming portion, wherein a toner image on a sheet-type paper formed at the image forming portion is contacted to the heat roll, and by the heat of the heat roll and the pressurization force, the toner image is heat-fixed to the sheet.

In the fixing device, the heat roll contacts the toner when fixing the toner on the sheet of paper, so the toner adheres to the heat roll. In order to remove the toner on the heat roll, a cleaning web and the like are mounted. In this case, so as to reduce the cleaning load, an application device for applying a release agent of a silicon oil and the like on the surface of heat roll is equipped, thereby performing the fixing operation while aggressively preventing toner from being adhered to the heat roll.

The application device supplies and applies the release agent stored in a tank by sucking up the release agent with an application member to an application roll being pressed against and rotated against a surface of the heat roll, thereby applying the release agent applied to the application roll onto the heat roll. The application member has one end portion being submerged to the release agent in the tank, and the other end being pressed against the application roll. The application member sucks up the release agent utilizing a capillary phenomenon (action), and applies the same to the application roll on the pressed portion. Thereby, the application member comprises of a felt and the like.

The application of release agent by the application member comprising a felt and the like is not stable of its application quantity. Therefore, the application quantity to the application roll is uneven. So when applying the release agent to the heat roll, an excessive application and the like will occur, which causes fouling of the sheet by the release agent or the fouling of the interior of the image forming device including the fixing device by the dripping of the excessive release agent. Therefore, a blade for removing the excessive release agent applied by the application member and for limiting the amount of the release agent on the surface of application roll so as to form an even layer (film thickness) is mounted on the downstream side of the rotational direction of the application roll.

The blade is a rubber blade for example having elasticity, wherein the tip end portion thereof is pressed against the surface of application roll. Therefore, a uniformly controlled (limited) release agent layer (film) will be formed on the surface of application roll, even in the direction of rotational axis, after the blade has passed through the surface.

The excessive release agent removed from the surface of application roll by the blade will either be sucked by the application member and returned to the tank, or gets over the application member and returned to the tank. Thereby, the unnecessary release agent will be collected and circulated for supply.

According to the conventional fixing device disclosed in the above-mentioned publication, the release agent could be uniformly applied to the heat roll, which prevents the excessive application of the release agent to the roll. Therefore, fouling of the paper by the release agent will not happen.

However, when removing the excessive release agent by the blade, the excessive release agent will, get over the application member to be collected by a tank and to be reused, but on the other hand, a part of the excessive release agent will drip off from the both end portions of the blade, which will not be collected by the tank, fouling the interior of the fixing device with the release agent.

This happens because the blade and the application member are mounted with a sufficient space in between so as to maintain the excessive release agent. When the amount of release agent being collected at this area increases, the excessive release agent will drip off from the both end portions of the blade.

The above-mentioned problem will now be explained in detail. By the starting of operation of the fixing device, the application roll will be rotated, and the release agent being sucked up by the capillary action of the application member will be supplied to the rotating application roll by the viscosity of the release agent. The application member supplies the release agent to the application roll, and at its tip portion, the release agent will be in an unsaturated state. So as to compensate the lack of release agent at the tip portion, the release agent will further be carried up by the capillary action, and will be supplied to the application roll. When such supply of the release agent is continued, the adherence quantity (supply quantity) of the release agent from the application member to the surface of application roll will, though the amount may differ by the characteristics and the surface roughness of the material of application roll, be approximately in the order of $10^{-3}$g/cm$^2$.

However, the amount of release agent necessary for fixing the image, or the adherence quantity of the release agent after the passing of the blade, is approximately 1/10 of that amount. Therefore, most of the release agent being applied by the application member is wiped away by the blade. The excessive or surplus release agent generated as above will travel along the edge portion which is the contacting portion of the application roll and the blade, and will drip off from the both side end portions of the blade as release agent drops. The interior of the fixing device and the image forming device will be fouled by the release agent if the dripping release agent will not be collected.

Therefore, the tank must be large enough to cover the whole lower area of the application roll for collecting the excessive release agent, and the tank should be positioned so as to protrude from the both side end portions of the application roll in the direction of rotational axis. Therefore, the application device itself will become large, and as a result, the whole fixing device will become large. Further, there is a need to mount a means for collecting the release agent, which will raise the cost.

Therefore, a device is considered where the amount of release agent supplied to the application member for applying the release agent to the application roll is limited, so that no excessive release agent will be applied to the application roll. For example, the above-mentioned Japanese Laid-Open Patent Publication No.6-202518 discloses a plan to stabilize the supply quantity of the release agent by mounting a filter cover made of a porous fluoroplastic and the like to the contacting portion of the tip of the application member and the application roll.

However, it is very troublesome to mount a fluoroplastic cover to the application member itself, and if the porous state is uneven, the quantity of supply will be changed greatly, and uniform application may not be performed by such supply disorder. Further, the application member will become expensive.

Further, the above-mentioned publication also proposes to remove the application member, and to mount a supply pump of the release agent, which pumps up the release agent and to spray the release agent through an application nozzle to the application roll. According to such structure, the amount of release agent to be supplied by the supply pump could easily be adjusted, which enables to control the supply of excessive release agent, and to reduce the amount of release agent to be removed by the blade, thereby enabling to restrict the dripping off and the like of the release agent.

However, such device requires a large-scale means such as supply pumps and application nozzles. This not only increases the size of the device, but also raises the cost greatly, so it is not suitable for the miniaturization or the cost-reduction in a device.

On the other hand, in the case where the excessive release agent is removed by the blade and collected by the tank for the reuse, the release agent may be deteriorated by the long-term use. In recent years, though, the release agent to be used in such devices utilize a silicon system oil which is chemically highly stable, and the problem of deterioration is solved to some extent.

However, by recycling and reusing the release agent, foreign matters such as the additive included in the toner or the toner itself will simultaneously be collected with the collection of the release agent. That is, the foreign matter adhered to the heat roll performing the fixing process will be adhered to the application roll, and will manage to pass through the application member and removed by the blade, and collected to the tank. As a result, many impurities will be mixed into the release agent, damaging the release ability or the glossiness of the image, and creates the cause of offsets.

This problem could not be solved by the above-mentioned methods, and it is a problem that could not be solved when recycling and reusing the release agent.

Therefore, a supply pump could be mounted without reusing the release agent, and by limiting the amount of supply, the release agent corresponding to the reduced amount of release agent could be applied. However, in such case, the size of the device will be increased as was explained above, and the problem of raise in the cost is left unsolved.

SUMMARY OF THE INVENTION

The object of the present invention is to solve the above-mentioned problems, and is aimed at limiting the amount of application of the release agent by a simple structure, and at the same time, solving the fouling caused by the dripping of the release agent without recycling the release agent.

Further object of the present invention is to solve the problem of the mixing-in of foreign matters, without using the recycled release agent.

A fixing device equipped in an image forming device according to the present invention for achieving the above-mentioned objects comprises a heat roll having a surface being heated to a desired temperature by a heating source, and a pressurization roll for contacting to said heat roll side a recorded medium holding an unfixed image pressurized and transmitted by said heat roll, for forming an image by passing said recorded medium holding said unfixed image between said heat roll and said pressurization roll; wherein said fixing device further comprises an application member for applying a release agent to said heat roll for preventing adherence of said unfixed image held by said recorded medium to said heat roll, and a limiting member for removing the excessive release agent and applying the release agent uniformly after the application, wherein said limiting member is positioned adjacent to said application member.

According to such structure, the application quantity of the release agent to the heat roll from the application member, in other words the film thickness of the release agent, is uniformed by the limiting member limiting the excessive release agent. This excessive release agent will be absorbed to the tip of the application member or application region since the application member and the limiting member are positioned adjacently. This enables the release agent in the application region of the application member to be in a saturated state, which leads to self-adjustment of the supply of the release agent by the application member itself, and prevents oversupply of the release agent. This not only solves the problem of dripping of the excessive release agent and the fouling of the interior of the device by such dripping, but also provides a uniform application. Therefore, not only is it possible to contribute to the miniaturization of the device and the cost-reduction, but the freedom in design is also realized, since there will be no limit to the size and position of the tank for storing the release agent.

Further, since no circulation of the release agent would be performed by collecting and recycling the release agent, the problem of deterioration of the release agent or the mixing of foreign matter thereto could be solved, and the offset phenomenon could be prevented for a long time.

In the fixing device having the above-mentioned structure, especially in the application device of the release agent, the lack of supply of the release agent just after the starting of the device could be solved, the deterioration of the fixed image by the uneven application of the release agent could be prevented, and a high level image quality could be maintained by forming the application member from a fiber bundle of a non-woven fabric or a porous material, having a thickness of over 2 mm, and the weight per square meter set in the range of 250 through 700 g/m$^2$. Moreover, the time taken from the startup of the power of the image forming device to the starting of the image forming operation could be shortened. That is, since there is no need to wait for the supply of the release agent to be stabilized, the time could be shortened.

Moreover, in the fixing device having the above-mentioned structure, when the application member is a fiber bundle of a non-woven fabric and the like, and at least the region for applying said release agent is heat-treated, and provided with a process for removing short fiber, thereby solving the problem of the uneven application caused by unconscious insertion of fiber to the limiting member. That is, since fiber protruding to the application region of the application member no longer exists, no consideration will be necessary when assembling the application member. Therefore, the assembling process could be simplified.

Further, in the fixing device having the above-mentioned structure, when a plurality of partial notch portions are formed at even intervals to said application member for applying said release agent, the problem of dripping of the excessive release agent could be solved by absorbing the generated excessive release agent at the notch portion regions. Especially, the excessive release agent is generated when the image forming device is frequently started and stopped, especially when the device is immediately restarted after it has been stopped. In such case, the problem of excessive release agent could be solved by the above-mentioned device, and a stable fixing enabling uniform application and constant image quality could be maintained.

As for the application structure of the release agent to the heat roll of the fixing device having the above-mentioned structure, an application roll for pressing and rotating against said heat roll, said application member being pressed against said application roll, and said limiting member being positioned adjacent to said application member are further comprised, wherein said release agent is applied uniformly to said application roll before being indirectly applied to said heat roll. Such structure enables to stabilize the application quantity of the release agent to the heat roll, and simultaneously prevents the fouling of the recorded medium by the excessive release agent. In other words, since the release agent is applied through the application roll, the excessive release agent will be absorbed by the application roll.

BRIEF DESCRIPTION OF THE DRAWINGS

FIGS. 6A and 6B are cross-sectional views for explaining the application status of the release agent in the application device comprised in the fixing device of the present invention, wherein FIG. 6A shows the application state by the application member according to the present invention, and FIG. 6B shows the application state by the prior art application member.

PREFERRED EMBODIMENT OF THE INVENTION

Figure 1:
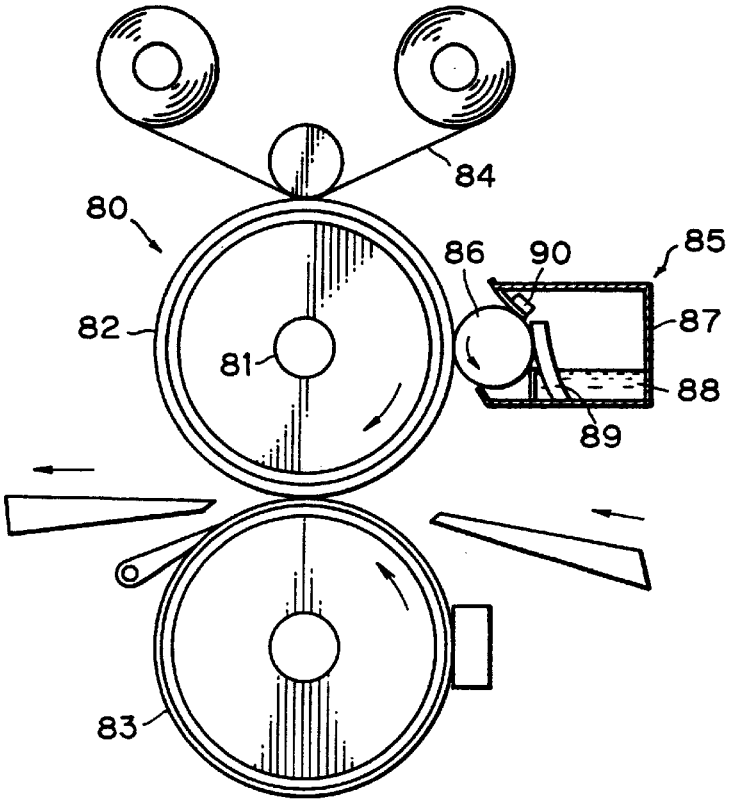
FIG.1 ( PRIOR ART )
FIG. 1 is a diagram showing the structure of the fixing device comprising the prior art application device.

One example of conventional fixing device is disclosed for example in Japanese Laid-Open Patent Publication No.6-202518, one example thereof being shown in FIG. 1. As shown in FIG. 1, a fixing device 80 is formed of a heat roll 82 having in the interior thereof a heater lamp 81 comprising a halogen lamp as the heating source, and a pressurization roll 83 pressurized to said heat roll 82 by a predetermined pressurization force.

The fixing device 80 shown in FIG. 1 is positioned on the upstream side of a discharge portion of the conveyance passage which passes through an image forming portion, wherein a toner image on a sheet-type paper formed at the image forming portion is contacted to the heat roll 82, and by the heat of the heat roll 82 and the pressurization force, the toner image is heat-fixed to the sheet.

In the fixing device 80 of FIG. 1, the heat roll 82 contacts the toner when fixing the toner on the sheet of paper, so the toner adheres to the heat roll. In order to remove the toner on the heat roll, a cleaning web 84 and the like are mounted. In this case, so as to reduce the cleaning load, an application device 85 for applying a release agent of a silicon oil and the like on the surface of heat roll 82 is equipped, thereby performing the fixing operation while aggressively preventing toner from being adhered to the heat roll 82.

The application device 85 supplies and applies the release agent 88 stored in a tank 87 by sucking up the release agent with an application member 89 to an application roll 86 being pressed against and rotated against a surface of the heat roll 82, thereby applying the release agent 88 applied to the application roll 86 onto the heat roll 82. The application member 89 has one end portion being submerged to the release agent 88 in the tank 87, and the other end being pressed against the application roll 86. The application member 89 sucks up the release agent utilizing a capillary phenomenon (action), and applies the same to the application roll 86 on the pressed portion. Thereby, the application member 89 comprises of a felt and the like.

The application of release agent by the application member 86 comprising a felt and the like is not stable of its application quantity. Therefore, the application quantity to the application roll 86 is uneven. So when applying the release agent to the heat roll 82, an excessive application and the like will occur, which causes fouling of the sheet by the release agent or the fouling of the interior of the image forming device including the fixing device by the dripping of the excessive release agent. Therefore, a blade 90 for removing the excessive release agent 88 applied by the application member 89 and for limiting the amount of the release agent 88 on the surface of application roll 86 so as to form an even layer (film thickness) is mounted on the downstream side of the rotational direction of the application roll 86.

The blade 90 is a rubber blade for example having elasticity, wherein the tip end portion thereof is pressed against the surface of application roll 86. Therefore, a uniformly controlled (limited) release agent layer (film) will be formed on the surface of application roll 86, even in the direction of rotational axis, after the blade 90 has passed through the surface.

The excessive release agent 88 removed from the surface of application roll 86 by the blade 90 will either be sucked by the application member 89 and returned to the tank 87, or gets over the application member 89 and returned to the tank 87. Thereby, the unnecessary release agent 88 will be collected and circulated for supply.

According to the conventional fixing device 80 shown in FIG. 1 disclosed in the above-mentioned publication, the release agent 88 could be uniformly applied to the heat roll 82, which prevents the excessive application of the release agent to the roll 82. Therefore, fouling of the paper by the release agent will not happen.

Figure 2:
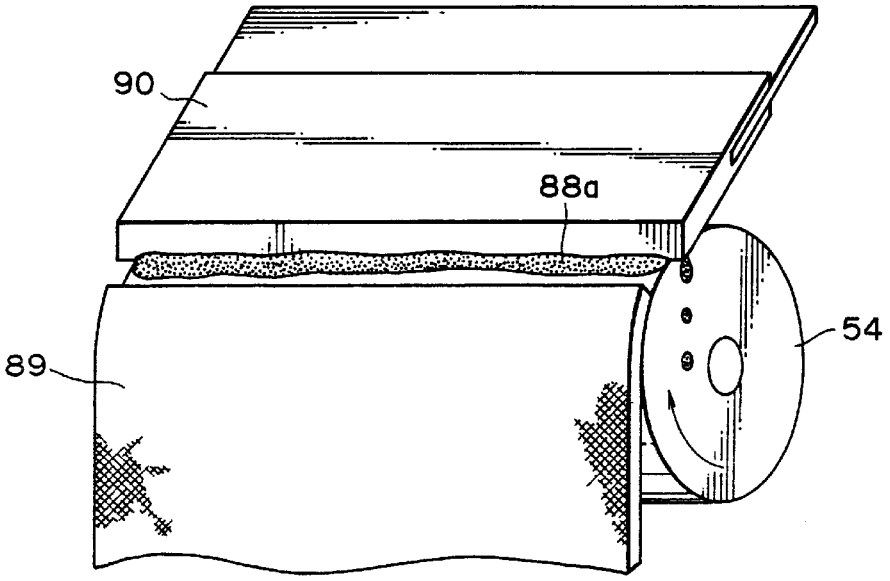
FIG.2 ( PRIOR ART )
FIG. 2 is a schematic view for explaining the dripping state of the excessive release agent caused by the excessive supply of release agent by the device shown in FIG. 1.

However, when removing the excessive release agent by the blade 90, the excessive release agent 88a will, as shown in FIG. 2, get over the application member 89 to be collected by a tank 87 and to be reused, but on the other hand, a part of the excessive release agent 88a will drip off from the both end portions of the blade 90, which will not be collected by the tank 87, fouling the interior of the fixing device 80 with the release agent.

This happens, as shown FIG. 1 and the like, because the blade 90 and the application member 89 are mounted with a sufficient space in between so as to maintain the excessive release agent 88*a*. When the amount of release agent 88 being collected at this area increases, the excessive release agent 88*a* will drip off from the both end portions of the blade 90, as shown FIG. 2.

The above-mentioned problem will now be explained in detail. By the starting of operation of the fixing device, the application roll 86 will be rotated, and the release agent 88 being sucked up by the capillary action of the application member 89 will be supplied to the rotating application roll 86 by the viscosity of the release agent. The application member 89 supplies the release agent 88 to the application roll 86, and at its tip portion, the release agent 88 will be in an unsaturated state. So as to compensate the lack of release agent at the tip portion, the release agent 88 will further be carried up by the capillary action, and will be supplied to the application roll 86. When such supply of the release agent 88 is continued, the adherence quantity (supply quantity) of the release agent from the application member 89 to the surface of application roll 86 will, though the amount may differ by the characteristics and the surface roughness of the material of application roll 86, be approximately in the order of $10^{-3}$g/cm$^2$.

However, the amount of release agent necessary for fixing the image, or the adherence quantity of the release agent 88 after the passing of the blade 90, is approximately 1/10 of that amount. Therefore, most of the release agent 88 being applied by the application member 89 is wiped away by the blade 90. The excessive or surplus release agent 88*a* generated as above will, as shown in FIG. 2, travel along the edge portion which is the contacting portion of the application roll 86 and the blade 90, and will drip off from the both side end portions of the blade 90 as release agent drops. The interior of the fixing device and the image forming device will be fouled by the release agent if the dripping release agent 88*a* will not be collected.

Therefore, the tank 87 must be large enough to cover the whole lower area of the application roll 86 for collecting the excessive release agent 88*a*, and the tank 87 should be positioned so as to protrude from the both side end portions of the application roll 86 in the direction of rotational axis. Therefore, the application device 85 itself will become large, and as a result, the whole fixing device 80 will become large. Further, there is a need to mount a means for collecting the release agent 88, which will raise the cost.

Therefore, a device is considered where the amount of release agent supplied to the application member 89 for applying the release agent 88 to the application roll 86 is limited, so that no excessive release agent 88*a* will be applied to the application roll 86. For example, the above-mentioned Japanese Laid-Open Patent Publication No.6-202518 discloses a plan to stabilize the supply quantity of the release agent 88 by mounting a filter cover made of a porous fluoroplastic and the like to the contacting portion of the tip of the application member 89 and the application roll 86.

However, it is very troublesome to mount a fluoroplastic cover to the application member 89 itself, and if the porous state is uneven, the quantity of supply will be changed greatly, and uniform application may not be performed by such supply disorder. Further, the application member 89 will become expensive.

Further, the above-mentioned publication also proposes to remove the application member 89, and to mount a supply pump of the release agent 88, which pumps up the release agent 88 and to spray the release agent 88 through an application nozzle to the application roll 86. According to such structure, the amount of release agent 88 to be supplied by the supply pump could easily be adjusted, which enables to control the supply of excessive release agent 88*a*, and to reduce the amount of release agent 88*a* to be removed by the blade 90, thereby enabling to restrict the dripping off and the like of the release agent 88*a*.

However, such device requires a large-scale means such as supply pumps and application nozzles. This not only increases the size of the device, but also raises the cost greatly, so it is not suitable for the miniaturization or the cost-reduction in a device.

On the other hand, in the case where the excessive release agent 88 is removed by the blade 90 and collected by the tank 87 for the reuse, the release agent 88 may be deteriorated by the long-term use. In recent years, though, the release agent to be used in such devices utilize a silicon system oil which is chemically highly stable, and the problem of deterioration is solved to some extent.

However, by recycling and reusing the release agent 88, foreign matters such as the additive included in the toner or the toner itself will simultaneously be collected with the collection of the release agent 88. That is, the foreign matter adhered to the heat roll 82 performing the fixing process will be adhered to the application roll 86, and will manage to pass through the application member 89 and removed by the blade 90, and collected to the tank 87. As a result, many impurities will be mixed into the release agent 88, damaging the release ability or the glossiness of the image, and creates the cause of offsets.

This problem could not be solved by the above-mentioned methods, and it is a problem that could not be solved when recycling and reusing the release agent.

Therefore, a supply pump could be mounted without reusing the release agent 88, and by limiting the amount of supply, the release agent corresponding to the reduced amount of release agent could be applied. However, in such case, the size of the device will be increased as was explained above, and the problem of raise in the cost is left unsolved.

Figure 3:
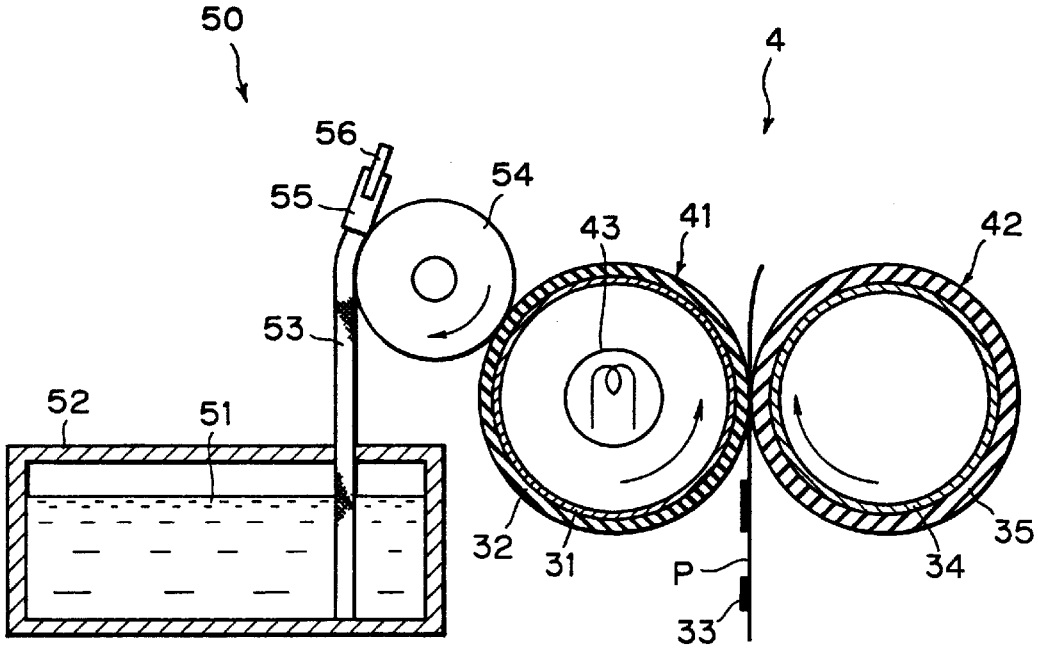
FIG. 3 is a cross-sectional view showing the simplified structure of the fixing device comprising the application device for explaining the first embodiment according to the present invention.

The embodiments of the present invention will now be explained with reference to the drawings. FIG. 3 is a cross-sectional view of a fixing device for explaining the first embodiment of the present invention, especially showing the structure of a fixing device comprising a release agent application device to apply the release agent to the heat roll contacting with the toner.

Figure 4:
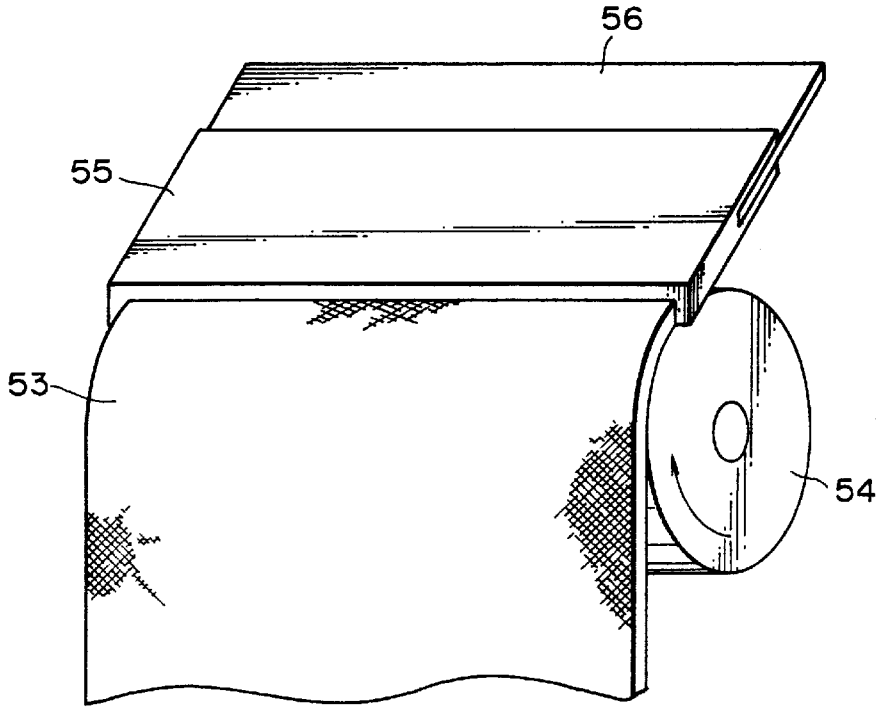
FIG. 4 is a schematic view showing the outline of the application device according to the present invention.
Figure 5:
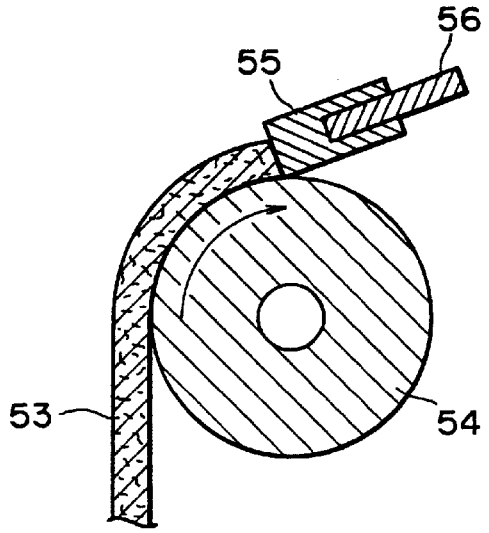
FIG. 5 is an enlarged cross-sectional view of the application device shown in FIG. 3.
Figure 6A:
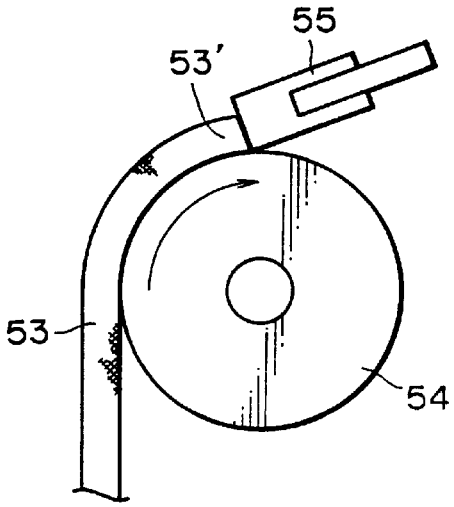
Figure 6B:
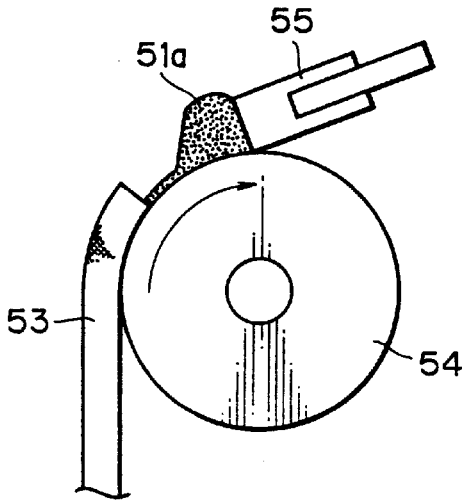
FIG.6B ( PRIOR ART )
Figure 7:
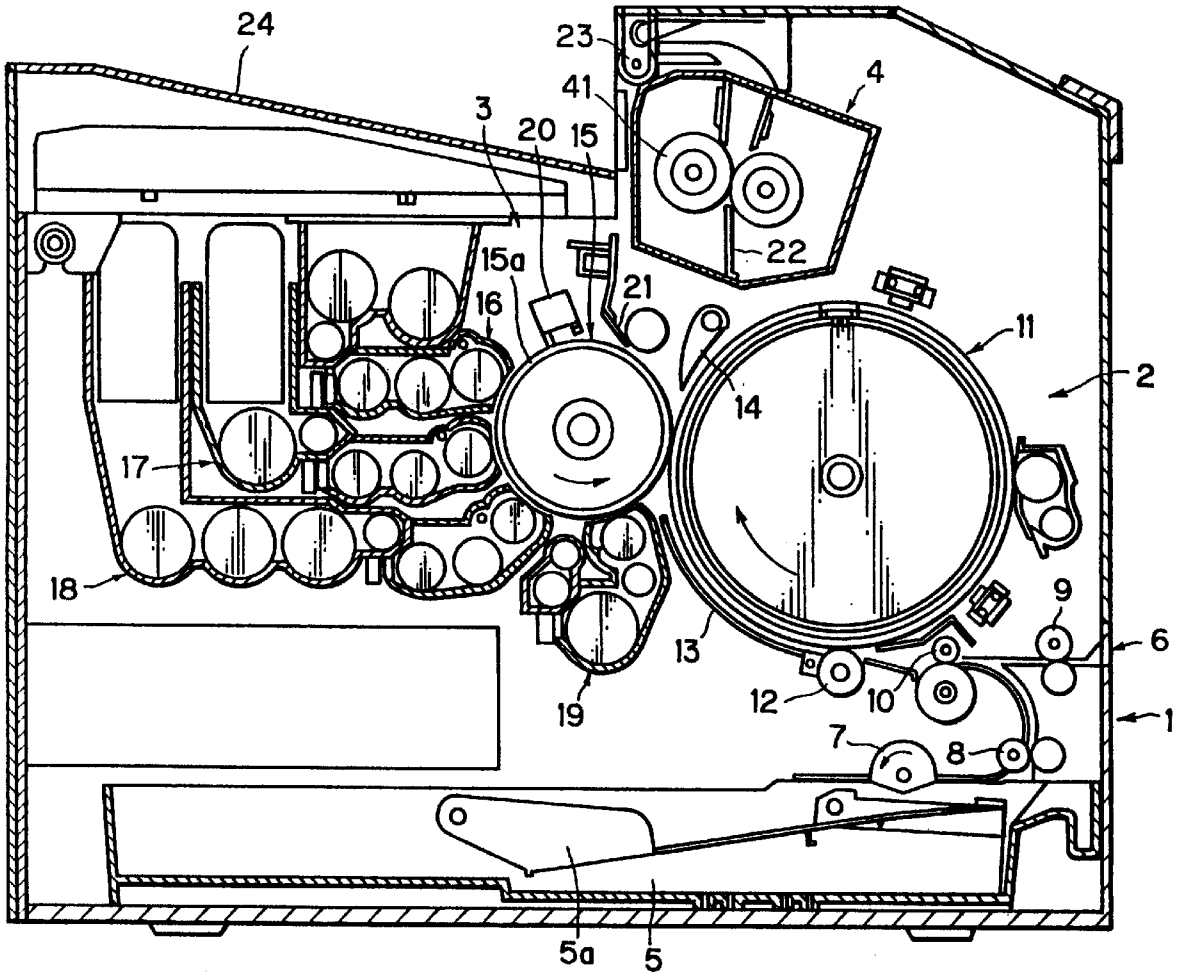
FIG. 7 is a diagram showing a simplified structure of the image forming device for forming a colored image equipped with a fixing device comprising the application member shown in FIG. 3.

FIG. 4 is a schematic view showing the exterior state of the application device of the first embodiment of the present invention, FIG. 5 is a cross-sectional side view thereof, and FIGS. 6A and 6B are explanatory views showing the operation of the application device, wherein FIG. 6A is an explanatory view of the application state according to the first embodiment of the present invention, and FIG. 6B is an explanatory view of the application state according to the prior art example. FIG. 7 is a drawing showing the whole structure of the image forming device comprising the fixing device according to the present invention as shown FIG. 3.

First, the whole structure of the image forming device comprising the fixing device according to the present invention is explained with reference to FIG. 7.

The image forming device shown in FIG. 7 is composed of a paper feed portion 1 for storing and supplying the sheet of paper which works as a recorded medium where the toner image will finally be formed, a transfer portion 2 for transferring a toner image to the sheet of paper, an image forming portion 3 comprising a developing device and the like for forming the toner image, and a fixing device 4 according to the present invention for melting and fixing the toner image transferred to the sheet.

On the paper feed portion 1 is mounted a paper feed cassette 5 for storing the sheets of paper positioned removably on the lowest area of the image forming device body, especially enabled to be pulled out from the front side or right side (the front side of the device) in the drawing, and a manual feed inserting portion 6 for inserting the sheets of paper manually positioned on the front side of the device body, or the right side of the drawing. Further, a pickup roll 7 for sending out one paper at a time from the top portion of the sheets of paper being stored inside the paper feed cassette 5, a PF roll 8 for conveying the sheet of paper sent out by said pickup roll, and a manual feed roll 9 for conveying the sheet of paper inserted from the manual feed inserting portion 6 are mounted. Even further, a pre-curl roll 10 for curling in advance the paper being conveyed from said PF roll 8 and said manual feed roll 9 is mounted thereto.

These units compose the paper feed portion 1. The paper is sent out from said paper feed portion 1 to the transfer portion 2 according to image forming orders.

On said paper feed cassette 5 is mounted a push-up member or sheet mounting table 5*a* forced toward the upper direction in the drawing by a spring and the like, and the sheets of paper are mounted on this sheet mounting table 5*a*. Thereby, the paper stored inside said paper feed cassette 5 is positioned so that the top paper thereof is opposed to the pickup roll 7, and by one rotary movement of the pickup roll 7 toward the direction of the arrow, the roll contacts the top sheet, and one paper will be sent out. The sent out paper is conveyed to the pre-curl roll 10 by way of the PF roll 8.

Further, the sheet of paper being inserted from the manual feed inserting portion 6 will also be conveyed to the pre-curl roll 10 through the manual feed roll 9.

The pre-curl roll 10 curls in advance the paper which had been conveyed as explained above, which makes the paper to be easily adsorbed and held at the surface of a cylindrical transfer drum 11 equipped at the transfer portion 2.

The cylindrical transfer drum 11 mentioned above is equipped to said transfer portion 2 as transfer means. On the peripheral area of said transfer drum 11, members such as a ground roll 12 working as a grounded electrode member, a guide member 13 for guiding the sheet so as not to fall from said transfer drum 11, a removing nail 14 for removing the sheet adsorbed to said transfer drum 11, and the like are positioned. The removing nail 14 is mounted movably so as to either contact to or separate from the surface of said transfer drum 11, and removes the sheet from the transfer drum 11 after the transfer has completed.

Further, in the image forming portion 3, a photosensitive drum 15 pressing against said transfer drum 11 is mounted as the image holding body. This photosensitive drum 15 is formed of a conductive aluminum pipe 15*a* being grounded, and an OPC film (organic optical conductive film), for example, is applied to the surface thereof.

On the peripheral area of said photosensitive drum 15, developers 16, 17, 18 and 19 each storing a toner of yellow, magenta, cyan, and black are positioned radially in order, and moreover, an electrifier 20 for electrifying the surface of said photosensitive drum 15, a cleaning blade 21 for sweeping off and removing the remainder toner on the surface of the photosensitive drum 15, and soon are positioned. In the image forming portion 3, a toner image is formed on said photosensitive drum 15 for each of said toners, and the image will be transferred one after the other on the sheet of paper wound around said transfer drum 11. Therefore, according to the photosensitive drum 15, electrification, exposure, development, and transfer is repeatedly performed for each color, thereby forming an image having the desired color on the paper.

Accordingly, when forming a colored image on the sheet of paper, a toner image is transferred to the sheet of paper adsorbed electrostaticly to the transfer drum 11, one color at a time for each one rotation of the transfer drum 11, thereby gaining a colored image with each color formed on top of the other, by a maximum of four rotations.

Further, the photosensitive drum 15 and the transfer drum 11 are pressed together so that a pressure of approximately 8 kg is added to the transfer position, especially in the contacting portion, from the point of view of transfer efficiency and image quality.

The toner image formed on the sheet of paper by the above-mentioned method is yet to be fixed, and in order to complete the image as a permanent image, a fixing device 4 for performing heat-fixing according to the present invention is positioned corresponding to the mounting position of the removing nail 14 of the transfer drum 11.

The fixing device 4, which will be explained in detail in the following, comprises a heat roll 41 for fixing the toner image formed on the sheet of paper by a predetermined temperature and pressure, and a fixing guide 22 for guiding the sheet removed from the transfer drum 11 by the removing nail 14 to the heat roll 41.

On the exit of the sheet in said fixing device 4, in other words, at the downstream side of the sheet conveyance, a discharge roll 23 is mounted, and the sheet completed of the fixture is discharged to a discharge tray 24 mounted on the exterior of the image forming device body. The discharge tray 24 is positioned on the upper portion of the image forming device, and mounted in a slant state.

The detail of the fixing device 4 according to the present invention will now be explained with reference to FIG. 3. The fixing device includes a heat roll 41 comprising a rubber covering layer 32 having an advantageous release ability against toner, such as silicon rubber, bonded and fixed thereto by an adhesive called a primer or the like on the surface of a cored bar 31 having a cylindrical shape formed of aluminum Al. In the interior of the cored bar 31 of the heat roll 41 is mounted a heater lamp 43 formed of a heating source such as a halogen lamp for maintaining the surface temperature of the heat roll to a fixable temperature (set temperature).

A pressurization roll 42 which is formed by covering a cored bar 34 supported rotatably with a PFA tube 35 of a silicon rubber or a sponge which is either or both thick and/or with low hardness, is mounted on the heat roll 41, thereby forming a considerable amount of contact width (nip width) for fixing the toner image 33 on the sheet of paper P efficiently between the heat roll 41 and the pressurization roll 42, and contacting the sheet P to the heat roll 41. The pressurization roll 42 improves the adiabatic performance by mounting said thick cover layer 35, and is also considered to reduce the temperature reduction of the surface of heat roll 41 on the image side, and forming a large nip width in the conveyance direction contacting said heat roll 41.

On the other hand, power supply to the heater lamp 43 is controlled so as to maintain the surface temperature of said heat roll 41 to a predetermined set temperature. In order to do so, a heat detection sensor (not shown) formed of a thermistor and the like is mounted to a position contacting the surface of the heat roll 41. Corresponding to the output from the heat detection sensor, the control of power supply to the heater lamp 43 is performed.

Further, a halogen lamp is used as the heater lamp 43 positioned inside the heat roll 41. However, other heating means such as a sheet type heating element, ceramic heater, xenon lamp, self-temperature control type ceramic heater (PTC) and the like could be used.

The sheet type heating element is formed of a heating element formed of a nichrome wire and the like being placed in a sheet-like shape, with the surface being covered by an insulating material such as an ethylene tetrafluoride or a polyimide, and it is preferable to be formed so as to secure the surface insulating performance and the smoothness. When utilizing the heating element as the heat source, the best heat transfer efficiency could be gained by directly contacting the element to the heat roll 41 to be heated, but it could also be positioned with a distance of a few millimeters from the heat roll. For example, the sheet-type heating element is mounted by adhering directly to the inner surface of the cored bar 31 comprised in the heat roll 41.

The ceramic heater is formed by printing a sheet-type heating resistor element of an MO system to an alumina ceramic substrate, then printing and laminating a glass coating thereto. The ceramic heater could be heated rapidly to the predetermined temperature by providing electricity to the heating resistor element, and the heating surface should be positioned either adjacent to, or contacting the surface of outer circumference of the heat roll 41.

The xenon lamp is a flash lamp including a xenon gas, and by impressing a high direct current pulse voltage between the electrodes positioned on the both ends of a tube, a radiation energy having a strong peak with a wave length of 566 nm will be generated. The xenon lamp has a high efficiency for heating the heat roll 41 from the exterior. Therefore, it will not be mounted in the interior of the roll 41, but will be positioned so as to oppose to the surface of outer circumference of the heat roll 41.

The self-temperature control type ceramic heater is a kind of ceramic heater, which is an element that will be heated if the current flowing through itself when impressing voltage is below a certain value. Therefore, by selecting the material, the surface temperature of the heating element when a certain voltage is impressed could be maintained to a predetermined temperature. By either positioning the self-temperature control type ceramic heater adjacent to or contacting the heat roll 41, the heat roll 41 could be heated from the exterior.

First Embodiment

The one pair of heat roll 41 and pressure roll 42 in the fixing device 4 of the present invention enable to form a high image quality. In order to especially gain a colored image of high quality, the heat roll 41 which contacts the unfixed toner image and fixes the same is equipped with a cover 32 of a silicon rubber and the like mentioned above.

Moreover, in order to perform the fixing, the surface temperature of the heat roll 41 must be maintained to a fixed value. There is a need to form a nip width (the width in which the two rolls contact each other) in the contacting portion between the pair of rolls 41 and 42. The setting of these values, that is the set surface temperature of the heat roll 41 and the nip width, will differ by the conveyance speed of which the sheet of paper P is conveyed in the image forming device or the characteristics of the toner being used, but generally, the set temperature of the heat roll 41 is controlled to a temperature where no fixing disorder will be generated, and to a temperature where no hot offset will occur.

The structure of the first embodiment of the application device 50 according to the present invention for aggressively preventing toner from adhering to the heat roll 41 surface, and for preventing the occurrence of hot offset in the fixing device 4 having the above-mentioned structure is explained in detail with reference to FIGS. 3 through 5.

The application device 50 is for applying to the surface of heat roll 41 a release agent 51 of a silicon oil and the like, wherein the release agent 51 is stored in a tank 52, and an application member 53 for sucking up the release agent 51 inside the tank 52 by a capillary action is positioned so as to be pressed against an application roll 54 being pressed and rotated against the heat roll 41.

Especially, the application member 53 has one end thereof being submerged to the release agent 51 being stored in the tank 52, and the other end thereof being pressed against and contacting to the surface of application roll 54. The contact position of the application member 53 to the application roll 54 is set to be in the opposite side of the position where the application roll 54 contacts the heat roll 41.

The application roll 54 is mounted rotatably so as to be driven by the rotation of the heat roll 41 for example. Therefore, when the image forming device is started of the image forming operation, the operation of the fixing device 4 will also be started, and the heat roll 41 will be rotated. Thereby, the application roll 54 will also be rotated by the heat roll 41. The application roll 54 may alternately be set to drive in the same direction without being driven, and the rotation speed or the like could be set optionally.

Further, the application device 50 is equipped with a limiting blade 55 for removing the excessive release agent 51 being applied to the application roll 54 by the application member 53, and to form a uniform release agent layer (film thickness) of a fixed quantity to the roll 54, which is placed so as to contact the application roll 54 at the downstream side in the direction of rotation of the application roll 54 than the tip portion of the application member 53. The blade 55 is mounted so that the edge portion on the tip thereof contacts the application roll 54, so as to wipe away the release agent 51 being supplied to the application roll 54, forming a release agent being adhered to across the whole surface in the direction of rotational axis of the application roll 54 passed through the blade 55 with a uniform thickness.

The heat roll 41 is formed by covering a silicon rubber layer 32 having a high rubber hardness and high heat conductivity to the surface of a tube (cored bar) 31 formed of aluminum and the like. Further, on the surface thereof is formed a LTV (low temperature vulcanizing) rubber layer having a good release ability. By contacting to the surface of heat roll 41 the application roll 54 of the application device 50 provided with the release agent 51 in a uniformly limited state, the release agent 51 could be applied uniformly to the surface of heat roll 41. The heat roll 41 will then contact the toner image 33 on the sheet P, and the toner image 33 will be melted and fixed by the heat of the heat roll 41 and the pressure of the pressurization roll 42.

In such fixing process, the adherence of toner to the heat roll 41 could be prevented aggressively since the release agent 51 is applied uniformly thereto.

Further, the application member 53 is formed either from a fiber bundle structure of non-woven fabric, like a felt for example, or a porous material. For example, by utilizing a fiber bundle structure, the capillary phenomenon between the fiber could be utilized to carry up the release agent 51. The member utilizes a conventional method. The blade 55 comprises an elastic supporting board 56 formed of a stainless steel as a base metal, having a fluororubber being molded integrally thereto so as to cover the tip portion. The other end of the supporting board 56 is fixed to an exterior frame and the like forming the fixing device 4. Therefore, by the elasticity of the supporting board 56, the tip of the blade 55 will be pressed against the application roll 54 with an appropriate pressure. Especially, the tip surface of the blade 55 contacting the application roll 54 is smoothed so as to form a uniform film thickness of the release agent 51.

Therefore, the main feature of the application device 50 according to the present invention is, as shown in the enlarged view of FIG. 5, that the tip of the application member 53 is positioned adjacent to the tip of the blade 55. Especially, the tip of the application member 53 and the tip of the blade 55 are positioned either to contact each other, or to be adjacent with a distance of less than 2 mm, preferably 1 mm in between.

By such formation, the release agent 51 could not only be sucked up (carried up) by the application member 53 and applied uniformly to the surface of heat roll 41 by the application roll 54, but the necessary amount of release agent 51 could be applied without performing the conventional circulation of providing and collecting the release agent 51. Therefore, the problem of dropping or leaking of the release agent 51 by the supply of excessive release agent 51 could be solved.

This is explained in detail with comparison to the conventional example with reference to FIGS. 6A and 6B. Especially in the prior art example, as shown in FIG. 6B, where the application member 53 and the blade 55 are positioned apart with a large distance in between, the excessive release agent 51*a* will be removed by the blade 55, and when the amount gradually increases, the release agent 51*a* will drip off as shown in FIG. 2, and the interior of the fixing device 4 and the image forming device will be fouled by the release agent.

That is, when the fixing process by the fixing device 4 is started, and the application roll 54 starts to rotate, the release agent 51 carried up by the capillary action of the application member 53 will be applied to the surface of application roll 54 by the viscosity of the release agent. Then, when the application member 53 provides the release agent 51 to the surface of application roll 54, the release agent at the tip portion of the application member will be in an unsaturated state, and the amount of release agent compensating the lack at the tip portion will further be sucked up by the capillary action, and supplied to the application roll 54. As such, the release agent 51 will continuously be supplied, and the adherence quantity of the release agent from the application member 53 to the application roll 54 will be in the order of $10^{-3}$g/cm$^2$, although it may differ by the physical characteristics of the release agent 51 or the surface roughness of the roll 54. However, the amount of release agent 51 necessary to fix the image is approximately 1/10 of the amount applied above. Therefore, most of the release agent 51 being provided will be wiped off by the blade 55, which becomes the excessive release agent 51*a* as shown in FIG. 6B.

Therefore, the amount of the release agent 51*a* being removed by the blade 55 will gradually be increased, and since the application roll 54 will be rotated continuously when the fixing process continues, the release agent 51*a* will remain at the tip portion of the blade 55. The remainder of excessive release agent 51*a* will not be of any problem when the rotation of the application roll 54 stops, since it will be reabsorbed by the application member 53. However, during the time the application roll 54 continues to rotate, the remainder will be gathered at the tip portion of the blade 55 by the viscosity of the release agent 51 without dripping downward, and will be accumulated gradually. Then, the accumulated excessive release agent 51*a* which will no longer be held thereto will drip from the both end portions thereof, and as a result, foul the interior of the device.

In contrast, the application device 50 of the present invention has the tip of the application member 53 and the tip of the blade 55 positioned either adjacent to or in contact with each other, as shown in FIG. 6A. Therefore, when the application roll 54 is driven by the starting of operation of the fixing device, the release agent 51 being sucked up by the application member 53 will be applied to the application roll 54 as a uniform release agent film by the blade 55. At this time, the excessive release agent 51*a* being wiped off by the blade 55 will exist in a state where it is impregnated to the tip of the application member 53. That region, especially the application region 53' will be in a state where the release agent 51 is saturated.

Since the tip application region 53' of the application member 53 is in a saturated state, the application member 53 will no longer suck up the release agent 51 by the capillary action. Thereby, the starting or stopping of the supply of the release agent 51 will be adjusted spontaneously, so no excessive release agent 51 will be supplied during the continuous rotation of the application roll 54. Therefore, no excessive release agent 51*a* will be accumulated in the contact region of the blade 55, and by the operation of the self-adjustment function, the problem of dripping of the release agent caused by the biased balance of supply could be solved.

Moreover, since there is no need to collect the release agent 51, the problem caused by the collecting operation will simultaneously be solved.

Therefore, according to the application device 50 equipped in the fixing device 4 of the present invention, the problem of the circulating supply of the release agent will be solved without mounting a special means separately, but with a very simple structure of adjacently positioning the tip of the application member 53 and the tip of the blade 55. The present invention also solves the problem of dripping of the release agent 51 by constantly supplying the necessary amount of release agent 51 by the self-adjustment function.

Next, an experiment disclosed in the following was performed to further confirm the application effect by the application device 50.

As the application member 53 being used in the experiment, the fiber bundle having a thickness of more than 2 mm, and the value (weight per square meter) showing the fiber bundle density being in the range of 250 through 700 g/m$^2$ was used. This was determined by also considering the lack of application quantity of the release agent 51 likely to occur just after the starting of rotation of the application roll 54 being stopped for a long time. The present member not only enables to supply a constant quantity, but also to prevent the application of excessive supply of the release agent, to prevent the generation of excessive release agent 51*a*, and to solve the dripping of the release agent.

Generally, the silicon oil used as the release agent 51 for preventing the occurrence of offset has a small surface tension, with a high viscosity of over 100cs in normal temperature. Therefore, in the state where the image forming device is not driven for a long time, the release agent 51 in the saturated state shown in FIG. 6A will move downward through the application member 53. When the operation was restarted from such state, the release agent 51 remaining in the tip area of the blade 55 will be consumed instantly, and the lack of supply of the release agent may occur. Such problem may lead to occurrence of uneven film thickness of the release agent 51 applied on the surface of application roll 54 passed through the blade 55. To solve this problem, there is a need to promptly supply the release agent by the application member 53.

Therefore, it is necessary to increase the thickness of the application member or to reduce the fiber bundle density thereof, as was explained above, so as to easily move the release agent in the application member 53.

According to an experiment, when using a dimethyl silicon oil with a surface tension of 20.9 dyne/cm and a viscosity of 20.5 cs at the temperature of 150° C., and the rotation speed of the application roll 54 set to 88 mm/sec, it was necessary that the application member 53 be set to a thickness of more than 2 mm, and the density of the fiber of less than 700 g/m$^2$.

Moreover, when the fiber bundle density of the application member 53 becomes too small, the amount of release agent 51 being maintained at that portion may become uneven according to location. Especially when such unevenness occurs in the tip area of the application member 53, the partial lack of release agent 51 may happen, and the film thickness of the release agent 51 applied on the surface of application roll 54 passed through the blade 55 may become uneven. Therefore, the lower limit of the fiber bundle density should be set to a value of 250 g/m$^2$ in the above-mentioned condition. The results is shown in Table 1.

TABLE 1

| application member thickness [mm] | weight per square meter [g/m$^2$] 200 | 250 | 500 | 700 | 925 |
|---|---|---|---|---|---|
| 1.5 | — | Δ | X | X | X |
| 2.0 | — | ○ | ○ | ○ | X |
| 3.0 | — | ○ | ○ | ○ | Δ |
| 5.0 | — | ○ | ○ | ○ | Δ |

The supply result of the release agent 51 in the above Table 1 is as follows:
○: the supply of release agent is sufficient, and the formed film thickness is stable;
Δ: supply shortage of release agent will occur at the beginning of operation after being left unoperated for a long time;
X: supply shortage of release agent will occur by normal operation; and
—: the thickness of the thin film of release agent being formed is uneven.

As shown in Table 1, in order to compensate for the supply shortage of the release agent 51 at the beginning of operation after being left unoperated for a long time and to limit the supply of excessive release agent 51, the thickness of the application member 53 should be set to more than 2 mm, and the value of the fiber bundle density should be set to a range from 250 through 700 g/m$^2$, thereby promoting the effect by the fixing device according to the first embodiment.

Second Embodiment

On the other hand, as was explained in the first embodiment of the present invention, by positioning the tips of the blade 55 and the application member 53 adjacently (including a distance of under 1 mm), the release agent 51 could be supplied appropriately, and could be applied uniformly. However, the fiber on one area in the application member 53 may be positioned in the contact portion between the blade 55 and the application roll 54, which may bring about a stripe-like irregular application caused by the fiber inserted in the rotational direction, or forming an uneven film.

This kind of stripe in the release agent 51 was caused, in the prior art, when the blade 55 was deteriorated and a chip or crack is generated at the tip portion thereof (in the edge portion contacting the application roll 54), since the gap between the application roll 54 and the blade 55 is increased in the chipped or cracked portion, and the amount of release agent 51 passing through such portion is increased.

However, as shown in FIG. 6A, since the application member 53 is positioned adjacent to the area where the blade 55 and the application roll 54 contact, the short pieces of fiber composing the application member 53 may easily get into the contact portion between the blade 55 and the application roll 54. As a result, as was explained above, an uneven area in the film thickness was locally generated which is similar to the case where a crack was formed in the tip of the blade 55.

The short pieces of fiber may not only get into the contact portion at the time of assembly of the device, but by the repeated operation of the device for a long period of time, the fiber on the tip portion of the application member 53 may move into the contact portion.

Therefore, in order to also solve such problem, the present invention removes the short fiber on the surface of the application member 53 in advance, especially the region contacting the application roll 54 or the region at the tip portion adjacent to the blade 55 by a heat treatment and the like. Thereby, the present invention could avoid the short fiber from entering between the blade 55 and the application roll 54.

The heat treatment could be performed by placing the application member 53 into an oven and the like, but it is not necessary to provide heat treatment to the whole surface of the application member 53, but rather, the treatment may only be provided to the surface contacting the application roller 54 and the tip portion opposing the blade 55. Therefore, the heating could be performed by a burner or an alcohol lamp and the like in order to remove the short fiber.

Since the fiber comprised in the heat treated portion of the application member 53 is melted and stuck firmly onto each other, no loose fiber will exist, so the problem of the uneven film thickness of the release agent 51 could be solved.

Third Embodiment

In the first and the second embodiments explained above, the problem of lack of supply of the release agent 51 when reoperating the fixing device 4 after a long interval is solved, or the stable supply of the release agent 51 when operating the device for a long period of time is aimed at, without recycling the supply of release agent 51.

However, it is rare for the fixing device 4 to either be reoperated after a long interval or to be continuously driven for a long time. Rather, the device 4 may be repeatedly operated and stopped frequently. In such case, the excessive release agent 51 may be gradually increased, and such excessive release agent may be collected.

That is, during the drive of the fixing device 4, the application roll 54 is rotated, and the state of the area adjacent to the blade 55 is as shown in FIG. 6A, where the release agent 51 in the application tip portion is in a saturated state. Therefore, the supply of the release agent 51 is adjusted, and excessive supply of release agent is prevented. Further, when the operation of the fixing device is stopped, the release agent in the tip portion of the application member 53 in the saturated state is moved downward, as was explained above. Thereafter, when the fixing device is reoperated in the state where the saturated release agent is not moved sufficiently to the downward direction, the release agent 51 will be pulled up again. If the operation is stopped again in such state, the starting and stopping of supply of the release agent 51 may be repeated continuously and frequently, which means that the quantity of the release agent existing in the tip portion of the application member 53 is greater than in the case of the generally driven state.

By the situation explained above, the release agent 51 will be in a supersaturated state in the very small region on the tip portion of the application member 53. In such state, the self-adjusting effect of the supply of release agent utilizing the capillary action may be weakened, and the excessive release agent 51*a* may be generated.

Figure 8:
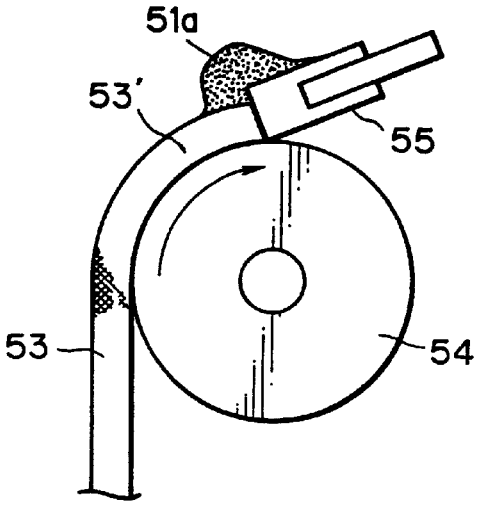
FIG. 8 is an explanatory view showing the state where an excessive release agent is generated in an application device.

Such state is shown in FIG. 8. As is shown in FIG. 8, tip region 53' of the application member 53 is in a state where the release agent 51 is supersaturated, and such region thereof is wider than the area shown in FIG. 6A of the regular drive state. In this case, the gap between the application member 53 and the blade 55 is very little, and the excessive release agent 51*a* is moved to the upper surface of the blade 55. The excessive release agent 51*a* is then in the state where it could be moved freely without being held by the application member 53, and as a result, drops off from the both end portions of the blade 55 as was explained in FIG. 2.

Especially, when a gap of approximately 1 mm is formed between the application member 53 and the blade 55, the dripping of the excessive release agent 51*a* could be solved since the excessive release agent may be secured, or maintained at the gap. When the operation is stopped for a long time, the excessive release agent 51*a* will be absorbed by the application member 53.

However, when more amount of excessive release agent 51*a* is generated, then some will drip off from the end portions of the blade 55.

Figure 9:
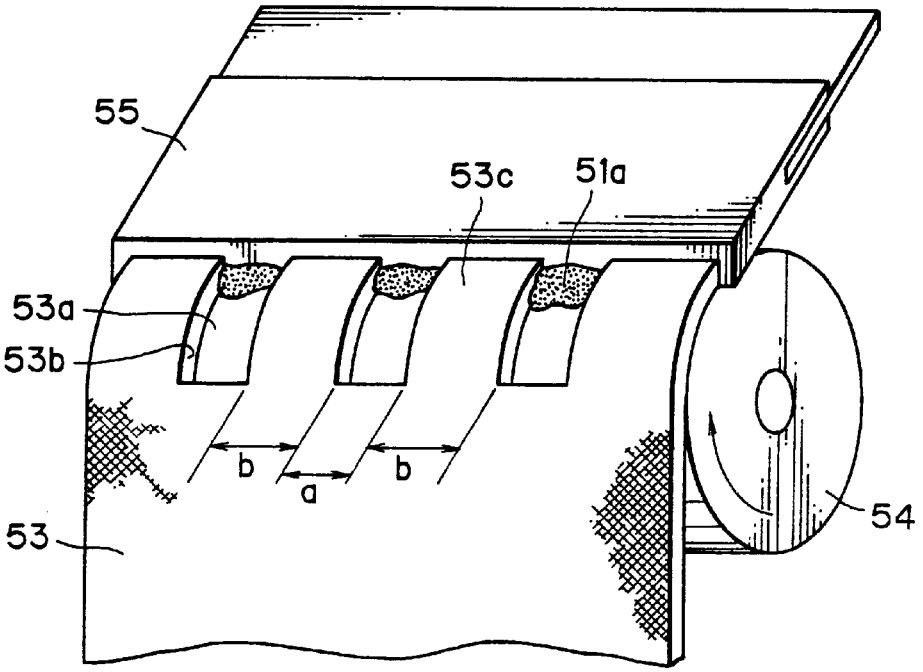
FIG. 9 is a schematic view showing the structure of the application device for explaining the second embodiment of the fixing device comprising the application device of the present invention.

When it is necessary to prevent such phenomenon, the application member 53 should be formed as shown in FIG. 9. That is, as shown in FIG. 9, a rectangular notch portion 53*a* with a fixed width (a) is formed at regular intervals of the application member 53 in the direction of rotational axis of the application roll 54.

By mounting a plurality of notch portions 53*a* partially to the application member 53, a space (concave portion) is generated between the application member 53 and the blade 55. Therefore, the excessive release agent 51*a* will be gathered to this portion, and the dripping of the release agent 51 from the both end portions of the blade 55 could be prevented. That is, the excessive release agent 51*a* travels along the surface of tip portion where the application member 53 and the blade 55 are positioned adjacent to each other, and is gathered to the notch portions 53*a*.

Further, when the quantity of the excessive release agent 51*a* is increased, the excessive release agent will move to the downward direction by traveling along the surface of the application member 53 (the side surface 53*b* of the notch portion 53*a*). At this time, since the release agent 51 is not in a saturated state in the area of the application member 53 excluding the tip region adjacent to the blade 55, the excessive release agent 51*a* will gradually be absorbed by the application member 53. Therefore, the problem of dripping of the excessive release agent 51*a* could be solved.

The generation and absorption of the excessive release agent 51*a* repeated in the area close to the tip of the application member 53, as was explained in this embodiment, actually happens in a very small region, and in reality, no excessive release agent is generated. Even if it may be generated, as was explained above, the excessive release agent could be held in the area approximate to the tips of the application member 53 and the blade 55, so it could be absorbed to the application member when the operation is stopped.

As was explained above, the third embodiment refers to the case where the fixing device 4 is continuously driven or stopped repeatedly and frequently. However, in the case of general image forming devices, such state, that is, the repeated reoperation of the device after a short interval, is not very likely to happen.

For example, in the case of the colored image forming device shown in FIG. 7, it will take time to start the image forming operation after the colored image data is received. During such time, the fixing device 4 is in a stopped state, and after the colored image data is received and the image is processed, the fixing device 4 is driven simultaneous to the starting of the recording operation. In order to form a colored image, at least three colored images are superposed. At this time, the paper P holding the unfixed toner image of three colors being superposed is transmitted to the fixing device 4. During such state, the operation of the fixing device 4 is stopped, or, the rotation of the heat roll 41 is stopped. In this case, the heat roll 41 is maintained at a fixable temperature.

Therefore, the operation of the fixing device 4 will not be started immediately after the operation is stopped, and in the case where the image forming must be performed immediately after the operation is stopped, the device will be driven continuously without being stopped and then restarted. That is, the device may be driven continuously, but may not be frequently restarted immediately after being stopped.

However, according to the image forming device where the stopping and restarting of the drive is frequently performed, especially where the operation is restarted immediately after being stopped, the problem of excessive release agent 51*a* being generated could be solved by mounting an application member 53 with a plurality of notches 53*a* being formed thereto as was explained in the third embodiment, and the problem caused by such excessive release agent could be solved completely.

A case is considered where a fixing device equipped with an application member 53 having the structure shown in FIG. 9 is continuously driven for a long period of time. At this time, no excessive release agent 51*a* exists in the portion corresponding to the position of the notch portions 53*a* of the application member 53 by absorption. Therefore, from the appearance of the application member, it may be feared that the lack of supply of the release agent 51 is generated at this portion, which may lead to an uneven application of the release agent 51 on the surface of application roll 54 passed through the blade 55.

However, in the notch portion 53*a*, the release agent 51 is maintained by the capillary action to the edge portion where the application roll 54 and the blade 55 contact each other. Therefore, the release agent 51 would be applied appropriately, and no application disorder will happen.

Figure 10:
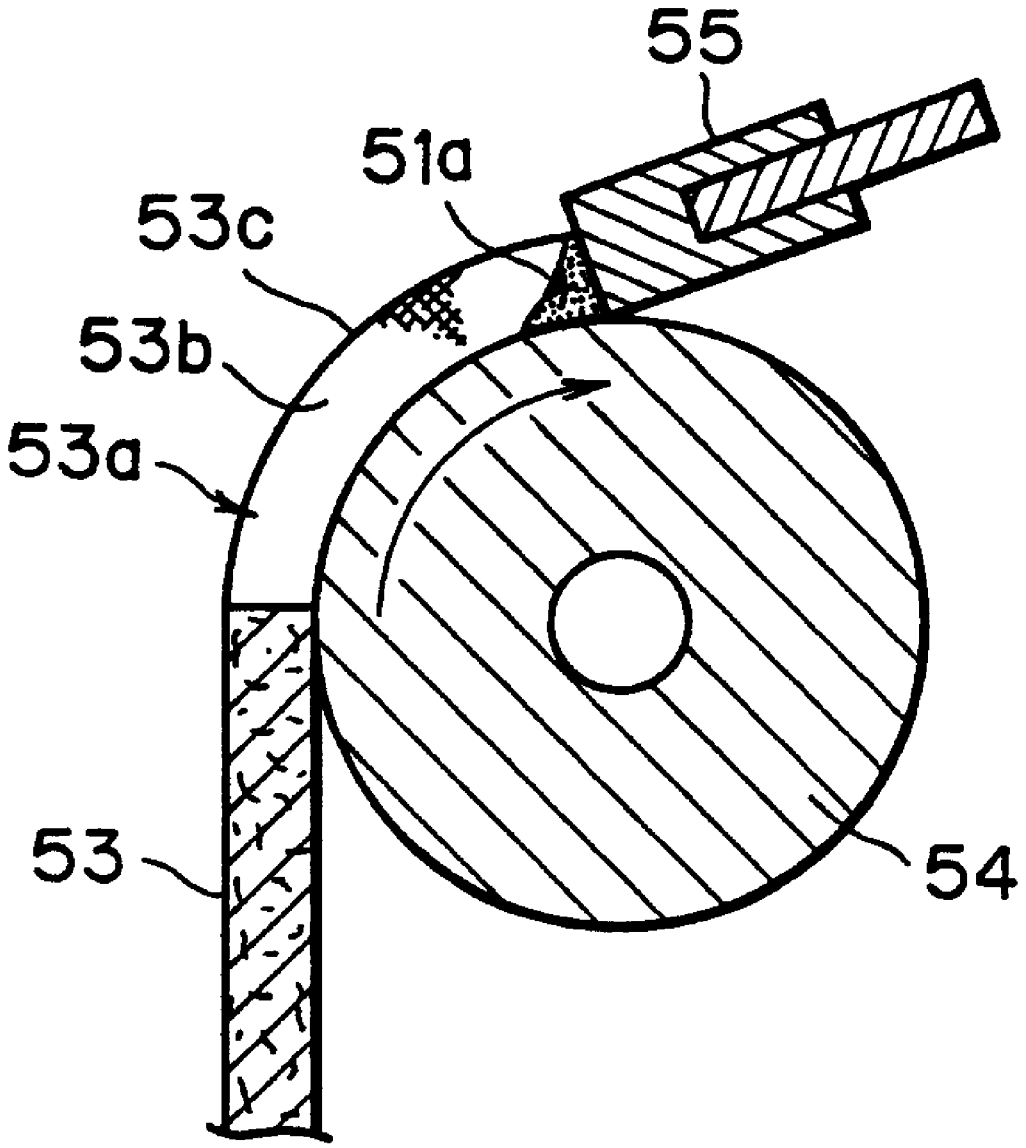
FIG. 10 is a cross-sectional view showing the cross-section of the main portion for explaining the application state of the release agent according to FIG. 9.

Further, FIG. 10 shows the cross-sectional view of the application member 53 shown in FIG. 9 with the notch portion 53*a*. In FIG. 10, the release agent 51*a* maintained at the tip edge portion of the blade 55 is supplied especially from the application member 53 on the both sides 53*b* of the notch portion 53*a*. Therefore, the release agent 51 could be supplied sufficiently even when said notch portions 53*a* are formed.

However, when the width a of the notch portion 53*a* is too large, then a problem occurs to the supply of the release agent. Therefore, it is necessary to set the width of each notch portions 53*a* narrower than the width b of the potion 53*c* of the application member 53 adjacent to the notch portions 53*a*. Moreover, the width a should be set to approximately 20 mm, though it may differ by the rotation speed of the application roll 54 or the supply quantity of the release agent by the application member 53, and it is more preferable to set the width to 10 mm or less. However, it could be set to more than that length according to the supply quantity.

Therefore, by forming the plurality of notch portions 53*a* with a small width a in even intervals, the supply of the release agent 51 by the application member 53 could be stabilized. Further, when the excessive release agent 51*a* is generated, the excessive release agent 51*a* could be absorbed by the notch portions 53*a*, thereby preventing the excessive release agent from dripping off from the both end portions of the blade 55.

Forth Embodiment

In the above-mentioned first, second and third embodiments, the release agent 51, for example, a silicon oil, applied to the fixing device 4 has a surface tension of less than 25 dyne/cm under the temperature of 25° C., and the application quantity should preferably in the range of $8\times10^{-6}$ through $5\times10^{-5}$g/cm$^2$ on the recorded medium or paper P.

The silicon oil and the like to be used as a release agent 51 generally has a very small contact angle of below 10° against a resin material or a rubber material, and holds a wettable character against various materials. In addition, when utilizing an oil whose surface tension exceeds 25 dyne/cm, the spreading of the oil to each portion will not be limited to the area explained in the above embodiments, but may spread to the end surface of the application roll 54 from the application member 53 for example. Therefore, there may be fear that the leak of the release agent 51 could not completely be prevented by the structure explained in the first and third embodiments of the present invention.

Therefore, in order to completely solve the problem of leakage of the release agent 51, the silicon oil and the like being used for the release agent 51 should be limited to the above-mentioned conditions. Such release agents were generally used in the prior art.

Further, in the fixing device and the like where the quantity of oil application to the recorded medium is extremely large, the suck-up quantity of the release agent 51 by the application member 53 must be large. In such case, the action of the release agent may not be performed according to theory disclosed in the embodiments. Moreover, in the case where the quantity of application of the release agent is extremely small, the film thickness of the release agent 51 on the surface of application roll 54 passed through the blade 55 may show very small unevenness caused by the dispersion in the density of the fiber bundle of the application member 53 itself positioned adjacent to the blade 55, or by the influence of the notch portion 53*a* being mounted in advance, which may cause an uneven application of the release agent to the image. Therefore, it is preferable that the release agent fulfill the surface tension condition and the application quantity condition mentioned above.

Further, in the application device 50 of the present invention, when applying the release agent 51 uniformly to the heat roll 41, the release agent 51 is first applied to the application roll 54, and then applied indirectly to the heat roll 41. According to such structure, the application quantity of the release agent 51 to the heat roll 41 is stabilized, and the paper P would no longer be fouled by the excessive release agent. Since the release agent 51 is applied through the application roll 54, no excessive release agent will be applied, or even if excessive release agent is applied, it will be absorbed to the application roll 54 side.

This is merely one example, and since according to the present invention the application of excessive release agent 51 could be reduced, so the device may even be formed so as to apply the release agent 51 to the heat roll 41 directly. That is, the application member 53 may be pressed directly to the heat roll 41, and the tip edge of the blade 55 positioned adjacent to the tip of the member 53 may be pressed to the heat roll 41. This could be realized by replacing the application roll 54 with the heat roll 41 in FIGS. 4, 5 and the like.

According to the fixing device of the present invention, in the application of a release agent for preventing the occurrence of offset, a simple structure enables to restrict the supply and application of an excessive release agent, thereby preventing the interior of the device from being fouled by the dripping or the like of the release agent. It is not necessary to increase the size of the image forming device including the fixing device when applying such structure, and therefore, the cost in introducing such image forming device is reduced. Further, the deterioration of the fixing image could be prevented by the uniform application of the release agent, which leads to constant stabilization of the image quality.

Further, the fiber of the application member will not provide a bad influence against the uniform application, and the heat treatment to the fiber enables the uniform application by a blade and the like.

Moreover, even if an excessive release agent has been generated by the driving and stopping of the device being repeatedly performed continuously and frequently, the trouble of the excessive release agent could easily be solved by mounting a plurality of notch portions to the application member. This further prevents the occurrence of uneven application of the release agent caused by supply disorder.

By performing the even application of the release agent through an application roll, the excessive release agent will not foul the paper, and in the fixing of colored images, the toner could be prevented from adhering to the heat roll. This enables to stabilize the image quality after the fixing process.

We claim:

1. A fixing device equipped in an image forming device comprising:

a heat roll having a surface being heated to a desired temperature by a heating source;

a pressurization roll for pressing a recorded medium holding an unfixed image to said heat roll, for fixing said unfixed image to said recorded medium by passing said recorded medium between said heat roll and said pressurization roll;

an application member for applying a release agent to said heat roll for preventing adherence of said unfixed image held on said recorded medium to said heat roll, said release agent being impregnated to the application member and applied to the heat roll by capillary action; and a blade member for controlling the release agent uniformly and removing an excessive release agent to be applied on said heat roll, said blade member being positioned adjacent a tip of the capillary of said application member in order to suppress a remaining release agent upstream of the blade member by the application member and to automatically control the amount of the release agent carried up by the application member.

2. A fixing device equipped in an image forming device according to claim 1, further comprising an application roll for rotating and pressing against said heat roll, said application member being pressed against said application roll, and said blade member being positioned adjacent to said application member, said release agent is applied uniformly to said application roll and then applied to said heat roll.

3. A fixing device equipped in an image forming device comprising:

a heat roll having a surface being heated to a desired temperature by a heating source;

a pressurization roll for pressing a recorded medium holding an unfixed image to said heat roll, for fixing said unfixed image to said recorded medium by passing said recorded medium between said heat roll and said pressurization roll;

an application member for applying a release agent to said heat roll for preventing adherence of said unfixed image held on said recorded medium to said heat roll;

a blade member for controlling the release agent uniformly and removing an excessive release agent to be applied on said heat roll, said blade member being positioned adjacent a downstream of said application member; and wherein said application member is formed from a fiber bundle of a non-woven fabric or a porous material, having a thickness of over 2 mm, and a weight per square meter set in the range of 250 through 700 g/m$^2$.

4. A fixing device equipped in an image forming device comprising:

a heat roll having a surface being heated to a desired temperature by a heating source;

a pressurization roll for pressing a recorded medium holding an unfixed image to said heat roll, for fixing said unfixed image to said recorded medium by passing said recorded medium between said heat roll and said pressurization roll;

an application member for applying a release agent to said heat roll for preventing adherence of said unfixed image held on said recorded medium to said heat roll;

a blade member for controlling the release agent uniformly and removing an excessive release agent to be applied on said heat roll, said blade member being positioned adjacent a downstream of said application member; and wherein said application member is a fiber bundle of a non-woven fabric and at least the region for applying said release agent is heat treated for removing short fiber.

5. A fixing device equipped in an image forming device comprising:

a heat roll having a surface being heated to a desired temperature by a heating source;

a pressurization roll for pressing a recorded medium holding an unfixed image to said heat roll, for fixing said unfixed image to said recorded medium by passing said recorded medium between said heat roll and said pressurization roll;

an application member for applying a release agent to said heat roll for preventing adherence of said unfixed image held on said recorded medium to said heat roll;

a blade member for controlling the release agent uniformly and removing an excessive release agent to be applied on said heat roll, said blade member being positioned adjacent a downstream of said application member; and wherein a plurality of notched portions are formed at even intervals to said applications member for applying said release agent.

* * * * *

UNITED STATES PATENT AND TRADEMARK OFFICE

CERTIFICATE OF CORRRECTION

PATENT NO. : 5,995,798
DATED : November 30, 1999
INVENTOR(S) : Norihiro Ochi, et al.

It is certified that error appears in the above-identified patent and that said Letters Patent is hereby corrected as shown below:

On Title page, item [56] insert the following:

U. S. PATENT DOCUMENTS

| EXAMINER INITIAL | | PATENT NUMBER | ISSUE DATE | PATENTEE | CLASS | SUBCLASS | FILING DATE IF APPROPRIATE |
|---|---|---|---|---|---|---|---|
| | | 4 3 0 9 9 5 7 | 1/12/1982 | | 118 | 60 | |

FOREIGN PATENT OR PUBLISHED FOREIGN PATENT APPLICATION

| | | DOCUMENT NUMBER | PUBLICATION DATE | COUNTRY OR PATENT OFFICE | CLASS | SUBCLASS | TRANSLATION YES | TRANSLATION NO |
|---|---|---|---|---|---|---|---|---|
| | EP | 0 8 5 5 6 3 1 A2 | 7/29/1998 | Europe | | | | x |
| | JP | 0 2 1 3 7 8 7 7 | 5/28/1990 | Japan | | | Abs | |
| | JP | 6 3 2 6 1 2 9 0 | 10/27/1998 | Japan | | | Abs | |
| | JP | 6 3 2 1 7 3 8 9 | 9/9/1988 | Japan | | | Abs | |
| | JP | 6 3 2 6 7 9 8 1 | 11/4/1988 | Japan | | | Abs | |
| | JP | 0 5 1 5 0 6 8 0 | 6/18/1993 | Japan | | | Abs | |
| | DE | 2 6 1 9 3 8 6 | 11/4/1976 | Germany | | | | x |
| | | | | | | | | |

Signed and Sealed this

Nineteenth Day of September, 2000

*Attest:*

*Attesting Officer*

Q. TODD DICKINSON

*Director of Patents and Trademarks*